US009976791B2

(12) United States Patent
Jung

(10) Patent No.: US 9,976,791 B2
(45) Date of Patent: May 22, 2018

(54) REFRIGERATOR AND METHOD OF CONTROLLING THE SAME

(71) Applicant: Dongbu Daewoo Electronics Corporation, Seoul (KR)

(72) Inventor: Chan Hee Jung, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 367 days.

(21) Appl. No.: 14/835,422

(22) Filed: Aug. 25, 2015

(65) Prior Publication Data

US 2016/0370095 A1 Dec. 22, 2016

(30) Foreign Application Priority Data

Jun. 17, 2015 (KR) ..... 10-2015-0085603

(51) Int. Cl.
*F25D 21/00* (2006.01)

(52) U.S. Cl.
CPC ..... *F25D 21/006* (2013.01); *F25D 2700/02* (2013.01); *F25D 2700/12* (2013.01)

(58) Field of Classification Search
CPC . F25D 21/006; F25D 2700/02; F25D 2700/12
USPC ..... 62/150
See application file for complete search history.

(56) References Cited

U.S. PATENT DOCUMENTS 3,075,366 A * 1/1963 Jung ..... F25D 17/065 62/285
4,615,179 A * 10/1986 Chiu ..... F25D 21/006 62/129
5,931,004 A * 8/1999 Yoo ..... F25B 5/04 62/179
6,133,555 A * 10/2000 Brenn ..... A47F 10/06 219/483
9,417,616 B2 * 8/2016 Ahn ..... G05B 13/02
2004/0117330 A1 * 6/2004 Ehlers ..... F24F 11/0012 705/412
2007/0033962 A1 * 2/2007 Kang ..... F25B 5/04 62/441
2007/0130966 A1 * 6/2007 Kim ..... F25D 21/08 62/150
2007/0283706 A1 * 12/2007 Kang ..... F25D 21/12 62/156
2010/0115973 A1 * 5/2010 Kondou ..... F25B 5/02 62/115
2011/0251807 A1 * 10/2011 Rada ..... G01D 4/00 702/61

(Continued)

FOREIGN PATENT DOCUMENTS

KR 10-1997-0047601 7/1997
KR 10-2000-0031395 6/2000
KR 10-2005-0002166 A 1/2005

*Primary Examiner* — Ljiljana Ciric

(57) ABSTRACT

A refrigerator includes a main body section having at least one storage chamber, a door section, a cooling cycle section, a temperature measurement section, a defrost section for removing frost adhered to the evaporator and a control unit configured to operate the refrigerator in a power-saving mode when at least one of operation conditions to calculate an operation ratio of the compressor for each predetermined check time in the power-saving mode, and to operate the defrost section when the operation ratio is equal to or greater than a predefined threshold operation ratio.

5 Claims, 5 Drawing Sheets

(56) References Cited

U.S. PATENT DOCUMENTS

| | | | | |
|---|---|---|---|---|
| 2014/0053581 | A1* | 2/2014 | Cho | F25D 21/008<br>62/80 |
| 2015/0047380 | A1* | 2/2015 | Liao | F25D 21/004<br>62/155 |

* cited by examiner

REFRIGERATOR AND METHOD OF CONTROLLING THE SAME

RELATED APPLICATION

This application is based on and claims priority to Korean Patent Application No. 10-2015-0085603, filed on Jun. 17, 2015, the disclosure of which is incorporated herein in its entirety by reference.

FIELD OF THE INVENTION

Embodiments according to the present invention relate to a refrigerator and a method of controlling the same, and more particularly to a refrigerator in which a defrost operation is immediately performed when an abnormality is detected in the refrigerator in a power-saving mode, and a method of controlling such a refrigerator.

BACKGROUND

A refrigerator is an apparatus aimed at storing foods at low temperature, and may store foods in a frozen or refrigerated state according to the type of food intended to be stored.

The refrigerator typically has a rectangular main body which is open at a front surface thereof. The main body section may have storage chambers, namely, a refrigerating chamber or compartment and a freezing chamber or compartment, therein. The front surface of the main body section may be provided with a refrigerating chamber door section and a freezing chamber door section, for selectively closing the respective portion. The refrigerator may include a plurality of drawers, shelves, and storage boxes, etc., in order to optimally store various foods in an internal storage space of the refrigerator.

The refrigerator includes a cooling cycle section or system for generation of cold air that is supplied to each storage chamber. The cooling cycle section may include a compressor which compresses a gas-phase refrigerant at high temperature and high pressure, a condenser which condenses the gas-phase refrigerant compressed by the compressor into a liquid-phase refrigerant, a capillary tube which changes the liquefied refrigerant into a low-temperature and low-pressure refrigerant, and an evaporator which cools ambient air by absorbing the latent heat of vaporization in order to evaporate the refrigerant liquefied at low temperature and low pressure by the capillary tube.

In more detail, the evaporator typically has a lower surface temperature than the temperature of air in the storage chamber. Thus, moisture present in the air in the storage chamber may be changed into frost and the frost may adhere to the surface of the evaporator. This frost causes a decrease in the heat exchange capability of the evaporator.

In order to remove the frost, the refrigerator may include a defrost section (defrost unit) such as an electric heater. The defrost section is operated when the frost needs to be removed, and the defrost section is not operated, but is stopped, when the storage chamber needs to be cooled. In this case, the operation and stoppage of the defrost section are repeated depending on the length of a predetermined defrost period.

The refrigerator may be operated in a power-saving mode (e.g., a low power consumption mode) introduced according to, for example, energy consumption regulations. The power-saving mode is an operation mode in which less power is consumed than usual. Accordingly, the defrost period in the power-saving mode (for instance, 48 hours or 72 hours) may be longer than a defrost period in an operation mode other than the power-saving mode (for instance, 8 hours) (hereinafter, the operation mode other than the power-saving mode is referred to as "normal mode"). The storage chamber (or the interior of the refrigerator) in the power-saving mode may have a higher temperature than that of the storage chamber in the normal mode. In addition, the compressor (inverter compressor) in the power-saving mode may have a lower rotation speed than that of the compressor in the normal mode.

However, when one or more of the following situations (hereinafter, referred to as an "abnormality") occurs in the power-saving mode, then the defrost period in the power-saving mode may cause an excessive amount of frost to accumulate (e.g., excessive adhesion of frost). For example, when opening of each door section is not detected due to failure of a door section sensor and warmer air is introduced through the door section, when minute opening of the door section is not detected by the door section sensor and warmer air is introduced through the door section, when a great quantity of frost is already present before the refrigerator is operated in the power-saving mode, or when a user uses only the freezing chamber (a user opens and closes only the freezing chamber door section) in a refrigerator in which the door section sensor is provided only in the refrigerating chamber, then the defrosting is performed in the defrost period in the power-saving mode even though the defrosting should be performed in a shorter period than the defrost period in the power-saving mode. For this reason, heat exchange degradation may result due to the excessive adhesion of frost.

Therefore, a technology for preventing the excessive adhesion of frost caused by an abnormality that occurs when in the power-saving mode would be valuable.

SUMMARY OF THE INVENTION

Therefore, the present invention has been made in view of the above problems, and it is an object of the present invention to provide a refrigerator which prevents the excessive adhesion of frost caused when defrosting is performed based on a defrost period in a power-saving mode in the event of an abnormality in the refrigerator, and a method of controlling the refrigerator.

An embodiment of the present invention provides a refrigerator that includes a main body section having at least one storage chamber, a door section coupled to the main body section, a cooling cycle section coupled to the main body section and comprising a compressor, a condenser, and an evaporator to generate cold air supplied to the storage chamber, a temperature measurement section for measuring a temperature of the storage chamber, a defrost section for removing frost adhered to the evaporator, and a control unit configured to operate the refrigerator in a power-saving mode when at least one operation condition is satisfied, the operation conditions including: the temperature of the storage chamber, the number of times the door section is opened and closed, a switching time of the door section, and whether or not the door section fails; the control unit also configured to calculate an operation ratio of the compressor at each predetermined check time in the power-saving mode, and to operate the defrost section when the operation ratio is equal to or greater than a predefined threshold operation ratio.

Further, the check time interval is shorter than a predefined defrost period in the power-saving mode.

Further, the control unit calculates the operation ratio based on a ratio of an operation time during which the compressor is operated to a sum of the operation time and a pause time during which the compressor is not operated.

Further, the control unit exits the power-saving mode when the operation ratio is equal to or greater than the threshold operation ratio.

Further, the control unit operates the compressor for each predefined defrost period in the power-saving mode when the operation ratio is less than the threshold operation ratio and operates the compressor before the compressor reaches the defrost period in the power-saving mode when the operation ratio is equal to or greater than the threshold operation ratio.

Another embodiment of the present invention provides a method of controlling a refrigerator. The method includes determining whether or not a refrigerator is operating in a power-saving mode, based on whether or not at least one operation condition is satisfied, the operation conditions including a measured temperature of at least one storage chamber formed in the refrigerator, the number of times a door section coupled to a main body section of the refrigerator is opened and closed, a switching time of the door section, and whether or not the door section fails. The method further includes calculating an operation ratio of a compressor at each predetermined check time, in a cooling cycle section generating cold air supplied to the storage chamber and comprising the compressor, a condenser, and an evaporator, when the refrigerator is operated in the power-saving mode, comparing the operation ratio with a predefined threshold operation ratio, and operating a defrost section for removing frost adhered to the evaporator when the operation ratio is equal to or greater than the threshold operation ratio.

Further, the check time interval is shorter than a predefined defrost period in the power-saving mode.

Further, in the operation of calculating an operation ratio, the operation ratio is calculated based on a ratio of an operation time during which the compressor is operated to a sum of the operation time and a pause time during which the compressor is not operated.

Further, the method includes exiting the power-saving mode when the operation ratio is equal to or greater than the threshold operation ratio.

Further, in the operation of operating a defrost section, the compressor is operated for each predefined defrost period in the power-saving mode when the operation ratio is less than the threshold operation ratio and the compressor is operated before reaching the defrost period when the operation ratio is equal to or greater than the threshold operation ratio.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE INVENTION

Example embodiments of the present invention will be described below in detail with reference to the accompanying drawings.

In certain embodiments, detailed descriptions of relevant constructions or functions well known in the art may be omitted to avoid obscuring aspects of the disclosure.

In the disclosure, "refrigerators" are home appliances for supplying cold air to foods and other objects, and are referred to as refrigerating/freezing apparatuses configured as refrigerators, freezers, or combinations thereof. Example embodiments of the present invention will be described based on the premise that the term "refrigerator" mentioned below refers to one of refrigerating/freezing apparatuses configured as refrigerators, freezers, or combinations thereof.

Figure 1:
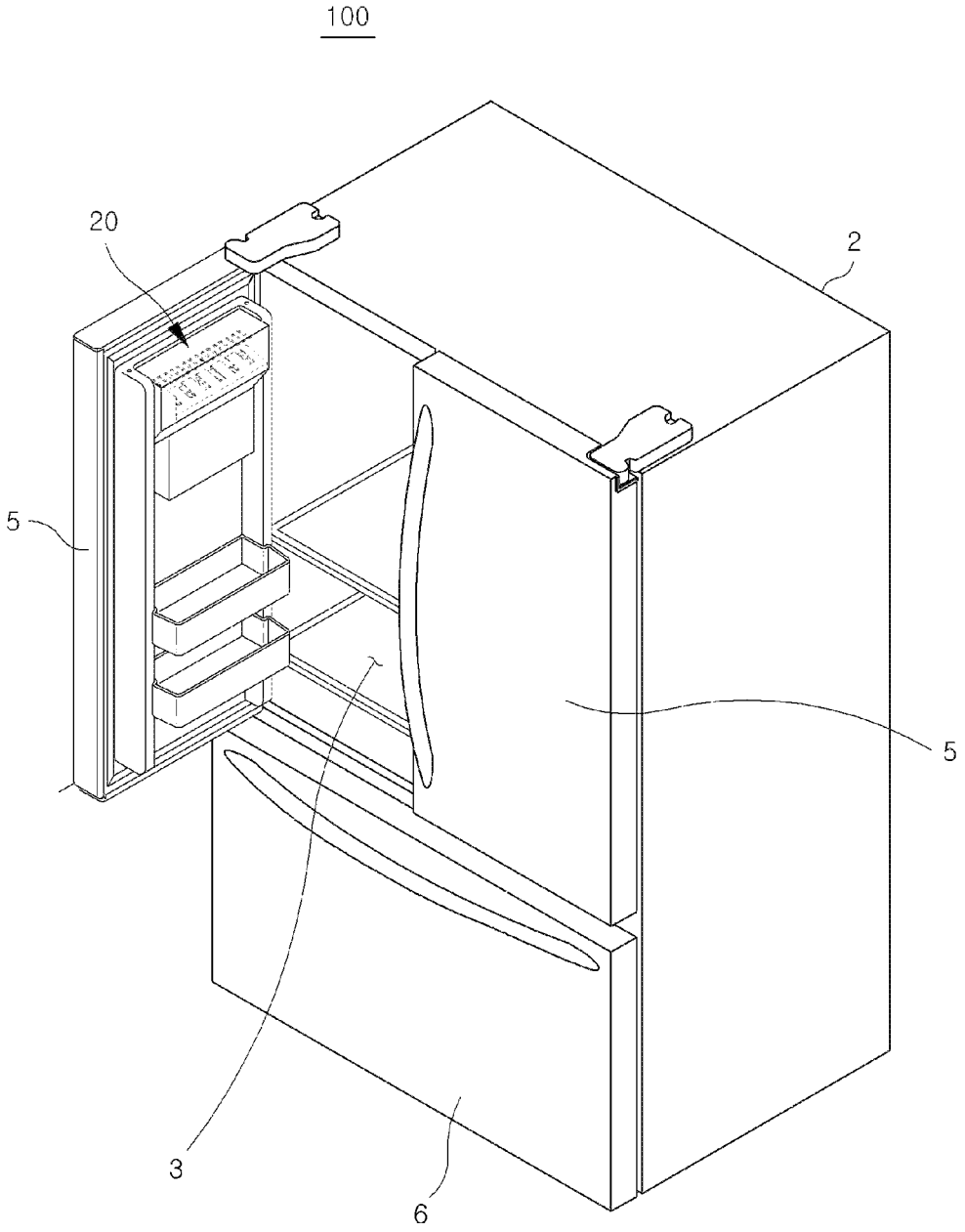
FIG. 1 is a perspective view illustrating a refrigerator according to an embodiment of the present invention.
Figure 2:
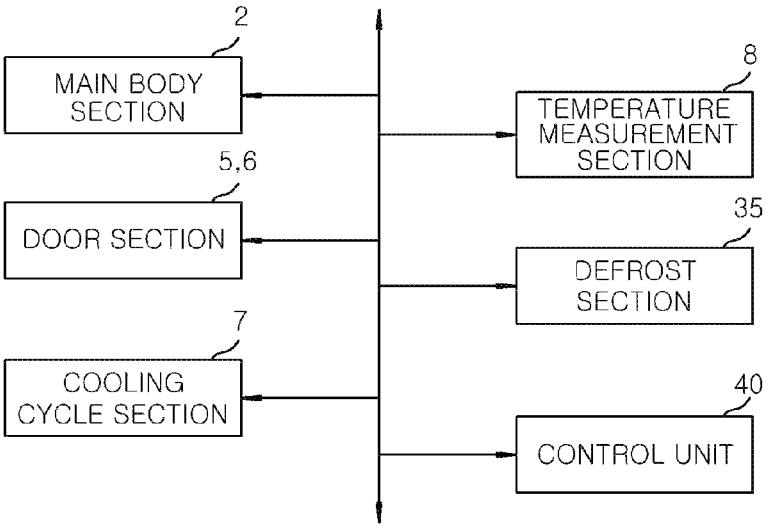
FIG. 2 is a block diagram illustrating a configuration of the refrigerator according to an embodiment of the present invention.

FIG. 1 is a perspective view illustrating a refrigerator according to an embodiment of the present invention. FIG. 2 is a block diagram illustrating a configuration of the refrigerator according to an embodiment of the present invention.

Referring to FIGS. 1 and 2, a refrigerator, which is designated by reference numeral 100, according to an embodiment of the present invention may include a main body section 2 defining an external appearance thereof, a barrier (not shown) formed inside the main body section 2 so as to divide a storage chamber for foods and other objects into an upper refrigerating chamber (compartment) 3 and a lower freezing chamber (compartment), a pair of refrigerating chamber door sections 5 provided at both front edges of the main body section 2 to selectively shield the refrigerating chamber 3 by rotation (opening and closing) thereof, a freezing chamber door section 6 for shielding a front opening portion of the freezing chamber, a dispenser section 20 mounted inside at least one of the refrigerating chamber door sections 5 to provide drinking water or ice made by an ice maker, a cooling cycle section (system) 7 for generating cold air supplied to the storage chamber, a temperature measurement section (system) 8 for measuring the temperature of the storage chamber, a defrost section (system) 35 for removing frost, and a control unit 40. However, since such a configuration is for illustrative purposes only, the refrigerator may not include one or more of the above components or may further include other components in certain embodiments. In addition, the positions of the refrigerating chamber 3 and the freezing chamber may be reversed in certain embodiments.

The temperature measurement section 8 can measure the temperature of the storage chamber and transfer the measured temperature to the control unit 40. The temperature measurement section 8 may be, e.g., a thermometer.

The cooling cycle section 7 generates cold air supplied to the storage chamber, and a description thereof will be given with reference to FIG. 3.

Figure 3:
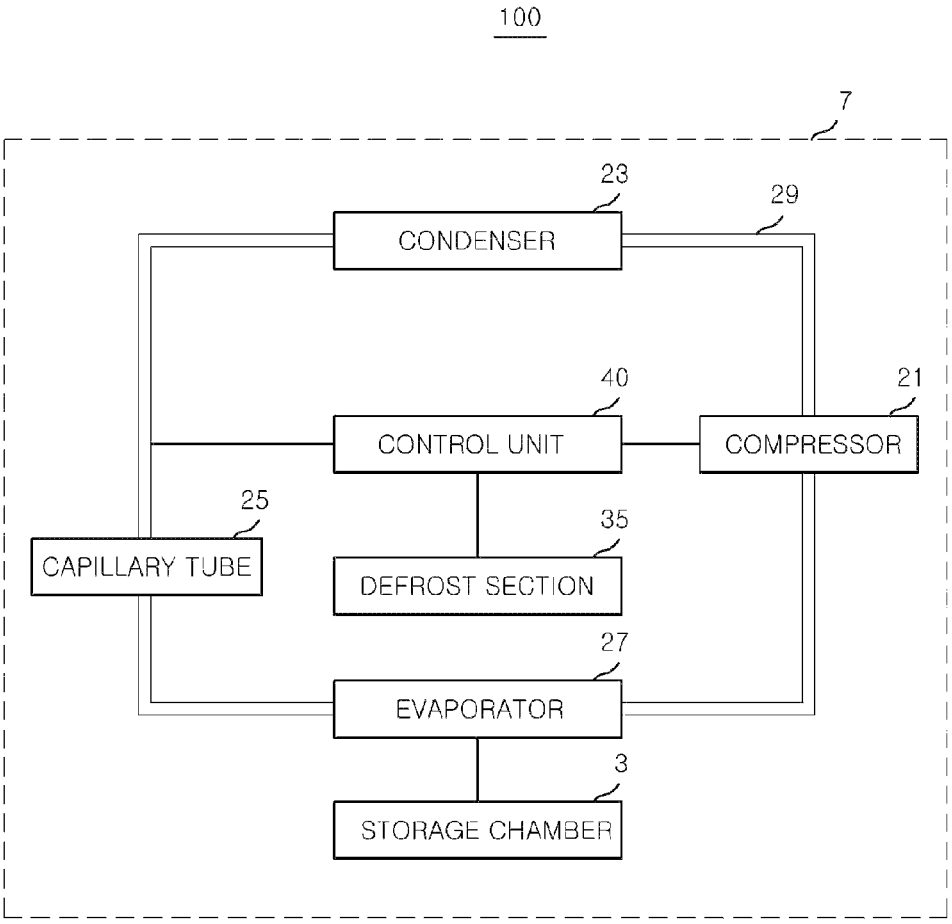
FIG. 3 is a diagram illustrating a connection relationship between a cooling cycle section, a control unit, and a storage section included in the refrigerator according to an embodiment of the present invention.

Referring to the example embodiment of FIG. 3, the cooling cycle section 7 includes a compressor 21 which compresses a gas-phase refrigerant at high temperature and high pressure, a condenser 23 which condenses the gas-phase refrigerant compressed by the compressor 21 into a liquid-phase refrigerant, a capillary tube 25 which changes the liquefied refrigerant into a low-temperature and low-pressure refrigerant, and an evaporator 27 which cools ambient air by absorbing the latent heat of vaporization in order to evaporate the refrigerant liquefied at low temperature and low pressure by the capillary tube. Since the compressor 21, the condenser 23, the capillary tube 25, and the evaporator 27 are typical components used in a refrigerator, detailed structural descriptions thereof will be omitted. In addition, operations of the compressor 21, condenser 23, capillary tube 25, and evaporator 27 may be controlled by the control unit 40.

In more detail, the evaporator 27 typically has a lower surface temperature than the temperature of air in the storage chamber 3. Thus, moisture present in the air in the storage chamber 3 may be changed into frost and the frost may adhere to a surface of the evaporator. If not removed, the frost causes a decrease in the heat exchange capability of the evaporator 27.

The defrost section 35 is a device for removing frost, and may be, e.g., an electric heater which generates heat using electric power supplied from the outside. Alternatively, the defrost section 35 may be configured to perform defrosting using heat generated by the compressor 21, the condenser 23, or the like.

The defrost section 35 may be arranged adjacent to the evaporator 27 as illustrated in FIG. 3 in order to remove frost around the evaporator 27, but the present invention is not limited thereto.

In connection with the operation of the defrost section 35 together with the compressor 21, when the storage chamber 3 needs to be cooled, the compressor 21 is operated and the defrost section 35 is not operated, but is stopped. On the other hand, when the frost needs to be removed, the compressor 21 is not operated, and the defrost section 35 is operated. The operation and stoppage of the defrost section 35 may be repeated depending on a predetermined defrost period and may be controlled by the control unit 40.

The control unit 40 may be, e.g., a calculation unit such as a computer including a microprocessor. In addition, the control unit 40 determines the operation mode (for instance, a normal mode or a power-saving mode) of the refrigerator 100, and thus may operate the refrigerator 100.

In more detail, the control unit 40 may control the operation and stoppage of the defrost section 35 and the operation and stoppage of the compressor 21 depending on the defrost period when the refrigerator 100 is operated in the normal mode. In this case, the defrost period in the normal mode may be, e.g., 12 hours. Here, since the processes of controlling the operation and stoppage of the defrost section 35 and the operation and stoppage of the compressor 21 by the control unit 40 in the normal mode are well known to those skilled in the art, a detailed description thereof will be omitted.

The refrigerator 100 may be operated in a power-saving mode (e.g., a low power consumption mode) introduced according to, for example, energy consumption regulations. In the power-saving mode, the refrigerator 100 consumes less power than when operating in the normal mode. To this end, the control unit 40 may control the temperature of the storage chamber at a higher temperature than the temperature of the storage chamber in the normal mode, may control the rotation speed of the compressor 21 at a lower speed than the rotation speed of the compressor 21 in the normal mode, and may set a defrost period such that the defrost period is longer than the defrost period of 12 hours in the normal mode, for example, it may set the defrost period to 48 hours.

The control unit 40 can determine whether the refrigerator is operating in the power-saving mode.

In addition, the control unit 40 can determine whether or not operation conditions for the power-saving mode are satisfied, and may change the operation mode of the refrigerator 100 from the normal mode to the power-saving mode based on the result of the determination. The operation conditions for the power-saving mode may include, for example, whether or not the temperature of the storage chamber 3 is lower than a predetermined threshold temperature, whether or not the number of times the door sections 5 and 6 are opened and closed is less than a predetermined threshold number of times in a predetermined period, and whether or not a user selects a "low power consumption mode" using a user interface portion (not shown) provided in the refrigerator 100, but the present invention is not limited thereto.

The control unit 40 may detect an abnormality when the refrigerator 100 is operated in the power-saving mode. Here, an abnormality means a situation in which frost excessively adheres to (accumulates in) the refrigerator 100 in the power-saving mode. For example, an abnormality may include a case where opening of the door sections 5 and 6 is not detected due to failure of a door section sensor (which is a sensor installed on, for example, the main body section 2 so as to detect opening/closing of the door sections and transfer the detected result to the control unit 40, and which is not illustrated in the drawings) and warmer air is introduced through the door sections, resulting in the excessive adhesion/accumulation of frost, a case where minute opening of the door sections 5 and 6 is not detected by the door section sensor and warmer air is introduced through the door sections, resulting in the excessive adhesion of frost, or a case where a great quantity of frost is already present before the refrigerator is operated in the power-saving mode. However, the above examples are for illustrative purposes only, and the present invention is not limited thereto.

The control unit 40 may detect the above abnormality by calculating an operation ratio of the compressor 21. That is, frost may excessively accumulate when an abnormality occurs, with the consequence that the operation ratio of the compressor 21 may reach ~70-80% or more by increasing beyond the ordinary operation ratio (for instance, ~30-40%). Accordingly, the control unit 40 may detect the abnormality by calculating the operation ratio. In this case, the operation ratio may be calculated using the following Equation 1.

$$\text{Operation ratio (\%)} = \frac{\text{operation time}}{\text{operation time} + \text{pause time}} \times 100 \qquad \text{[Equation 1]}$$

Here, the operation ratio may be calculated based on a ratio of an operation time during which the compressor 21 is operated to a sum of the operation time and a pause time during which the compressor 21 is not operated. The operation time may mean a time span during which the compressor 21 is operated, and the pause time may mean a time span during which the compressor 21 is not operated, but is stopped. In addition, the control unit 40 calculates the operation ratio at each predetermined check time (for instance, at intervals of two hours), and may detect an abnormality based on the calculated result. In an embodiment, the check time interval is shorter than the predefined defrost period in the power-saving mode.

The control unit 40 may immediately operate the defrost section 35 when the operation ratio is equal to or greater than a predetermined threshold operation ratio. That is, when the operation ratio is equal to or greater than the threshold operation ratio, the control unit 40 may immediately operate the compressor 21, regardless of the defrost period defined in the power-saving mode, even before the compressor 21 reaches the defrost period. Of course, when the operation ratio is less than the threshold operation ratio, the control unit 40 may operate the defrost section 35 when the defrost section 35 reaches a predefined defrost period in the power-saving mode.

Accordingly, in accordance with an embodiment of the present invention, the operation ratio is calculated in the power-saving mode and whether or not an abnormality occurs in the refrigerator is determined based on the calculated operation ratio. Then, when an abnormality is determined to occur, defrosting may be immediately performed regardless of the defrost period in the power-saving mode. Therefore, it may be possible to prevent heat exchange degradation due to the excessive adhesion/accumulation of frost.

When the operation ratio is equal to or greater than a threshold operation ratio, the control unit 40 may release (exit) from the power-saving mode. In this case, since the refrigerator 100 is returned to the normal mode, the defrost period may also be changed to a defrost period in the normal mode. Thus, excessive adhesion of frost may be more rapidly prevented due to the defrost period in the normal mode which is shorter than the defrost period in the power-saving mode.

Hereinafter, the operation and effect of the refrigerator according to the embodiment of the present invention will be described.

Figure 4:
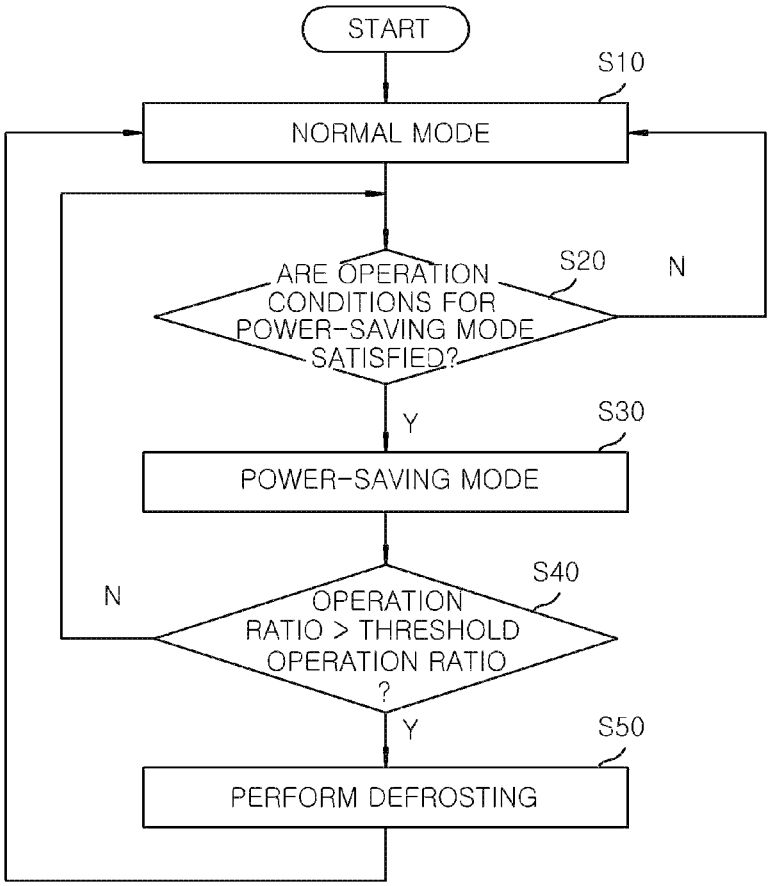
FIG. 4 is a flowchart illustrating a method of operating the refrigerator according to an embodiment of the present invention.

FIG. 4 is a flowchart illustrating a method of operating a refrigerator according to an embodiment of the present invention.

Referring to FIG. 4 together with FIGS. 1 to 3, the refrigerator 100 according to an embodiment of the present invention is first operated in the normal mode (S10). When the refrigerator 100 is operated in the normal mode, the control unit 40 can control the operation and stoppage of the defrost section 35 and the operation and stoppage of the compressor 21 depending on the defrost period. Since the processes of controlling the operation and stoppage of the defrost section 35 and the operation and stoppage of the compressor 21 by the control unit 40 in the normal mode are well known to those skilled in the art, a detailed description thereof will be omitted.

Then, the control unit 40 determines whether or not operation conditions for the power-saving mode are satisfied (S20). In this case, the operation conditions for the power-saving mode may include, for example, a case where the temperature of the storage chamber 3 is lower than a predetermined threshold temperature, a case where the number of times the door sections 5 and 6 are opened and closed is less than a predetermined threshold number of times in a predetermined period, and a case where a user selects a "low power consumption mode" using a user interface portion (not shown) provided in the refrigerator 100, but the present invention is not limited thereto.

When the operation conditions are not satisfied, the refrigerator 100 continues to be operated in the normal mode.

On the other hand, when the operation conditions are satisfied, the control unit 40 may change the operation mode of the refrigerator 100 from the normal mode to the power-saving mode (S30).

When the refrigerator 100 is operated in the power-saving mode, the control unit 40 can detect whether or not an abnormality occurs in the refrigerator 100. Here, an abnormality refers to a situation in which frost excessively adheres to (accumulates in) the refrigerator 100 in the power-saving mode. For example, an abnormality may include a case where opening of the door sections 5 and 6 is not detected due to failure of a door section sensor (which is a sensor installed to the main body section 2 so as to detect opening/closing of the door sections and transfer the detected result to the control unit 40, and is not illustrated in the drawings) and warmer air is introduced through the door sections, resulting in the excessive adhesion of frost, a case where minute opening of the door sections 5 and 6 is not detected by the door section sensor and warmer air is introduced through the door sections, resulting in the excessive accumulation and adhesion of frost, or a case where a great quantity of frost is already present before the refrigerator is operated in the power-saving mode. However, the above examples are for illustrative purposes only, and the present invention is not limited thereto.

The control unit 40 may detect the above abnormality by calculating an operation ratio of the compressor 21. That is, excessive frost may be present when the abnormality occurs, with the consequence that the operation ratio of the compressor 21 may reach a degree of ~70-80% or more by increasing beyond the ordinary operation ratio (for instance, ~30-40%). Accordingly, the control unit 40 may detect the abnormality by calculating the operation ratio. In this case, since the equation for calculation of the operation ratio is already described, a description thereof will be omitted at this point.

When the operation ratio is less than a predetermined threshold operation ratio as the result of comparison of the operation ratio with the threshold operation ratio, the control unit 40 may continue to operate the refrigerator 100 in the power-saving mode (S40).

On the other hand, when the operation ratio is equal to or greater than the threshold operation ratio, the control unit 40 may immediately operate the defrost section 35, regardless of the defrost period in the power-saving mode, even before the defrost section 35 reaches the above defrost period (S40). Consequently, the defrost section 35 may immediately perform defrosting (S50).

Accordingly, in accordance with an embodiment of the present invention, the operation ratio is calculated in the power-saving mode, and whether or not an abnormality occurs in the refrigerator is determined based on the calculated operation ratio. Then, when an abnormality is determined to occur, defrosting may be immediately performed regardless of the defrost period in the power-saving mode. Therefore, it may be possible to prevent heat exchange degradation due to the excessive accumulation and adhesion of frost.

Figure 5:
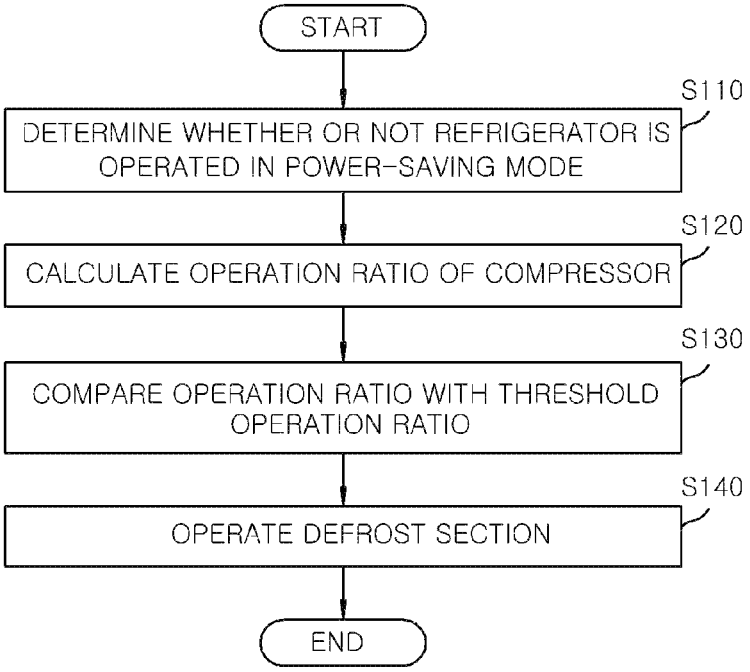
FIG. 5 is a flowchart illustrating a method of controlling the refrigerator according to an embodiment of the present invention.

FIG. 5 is a flowchart illustrating a method of controlling a refrigerator according to an embodiment of the present invention.

Referring to FIG. 5, the method of controlling the refrigerator according to an embodiment of the present invention may be performed by the control unit 40 illustrated in FIG. 2.

In the method of controlling the refrigerator, a step S110 of determining whether or not the refrigerator 100 is operating in the power-saving mode is first performed.

Next, when the refrigerator 100 is operating in the power-saving mode, a step S120 of calculating the operation ratio of the compressor 21 included in the cooling cycle section 7, which includes the compressor 21, the condenser 23, and the evaporator 27 and generates cold air supplied to at least one storage chamber 3 formed in the main body section 2 included in the refrigerator 100, is performed.

Next, a step S130 of comparing the operation ratio with a predefined threshold operation ratio is performed. Then, when the operation ratio is equal to or greater than the threshold operation ratio, a step S140 of operating the defrost section 35 for removing frost adhered to the evaporator 27 is performed.

The step S110 of determining whether or not the refrigerator 100 is operating in power-saving mode may be determined based on whether or not at least one of operation conditions including the temperature of the storage chamber 3, the number of times the door sections 5 and 6 coupled to the main body section 2 are opened and closed, the switching time of each of the door sections 5 and 6, and whether or not the door sections 5 and 6 fail is satisfied, but the present invention is not limited thereto.

Moreover, in the step S120 of calculating the operation ratio, the operation ratio may be calculated based on a ratio of an operation time during which the compressor 21 is operated to a sum of the operation time and a pause time during which the compressor 21 is not operated (Equation 1).

In the step S130 of operating the defrost section, the compressor 21 may be operated for each predefined defrost period in the power-saving mode when the operation ratio is less than a threshold operation ratio, and the compressor 21 may be operated before reaching the defrost period when the operation ratio is equal to or greater than a threshold operation ratio.

The method of controlling the refrigerator 100 according to an embodiment of the present invention may further include a step of releasing (exiting) the power-saving mode when the operation ratio is equal to or greater than the threshold operation ratio.

Since the above method of controlling the refrigerator according to the embodiment of the present invention is essentially, if not exactly, the same as the method of controlling the refrigerator 100 by the control unit 40 in FIGS. 1 to 4, additional description thereof will be omitted.

As is apparent from the above description, in accordance with an embodiment of the present invention, the operation ratio is calculated in the power-saving mode, and whether or not an abnormality occurs in the refrigerator is determined based on the calculated operation ratio. Then, when an abnormality is determined to occur, defrosting may be immediately performed regardless of the defrost period in the power-saving mode. Therefore, it may be possible to prevent heat exchange degradation due to the excessive adhesion of frost.

In accordance with the example embodiments of the present invention, heat exchange degradation due to the excessive adhesion of frost may be prevented by immediately performing defrosting in the event of an abnormality in a power-saving mode, for example, when opening of each door section is not detected due to failure of a door section sensor and warmer air is introduced through the door section, when minute opening of the door section is not detected by the door section sensor and warmer air is introduced through the door section, when a great quantity of frost is already present before a refrigerator is operated in the power-saving mode, or when a user uses only a freezing chamber (a user opens and closes only a freezing chamber door section) in the refrigerator in which the door section sensor is provided only in a refrigerating chamber.

Although embodiments of the present invention have been described for illustrative purposes, it will be apparent to those skilled in the art that various changes and modifications may be made without departing from the spirit and scope of the invention as defined in the following claims. More particularly, various variations and modifications are possible in concrete constituent elements of the embodiments. In addition, it is to be understood that differences relevant to the variations and modifications fall within the spirit and scope of the present disclosure defined in the appended claims.

What is claimed is:

1. A method of controlling a refrigerator, comprising:

determining whether or not a refrigerator is operating in a power-saving mode, based on whether or not at least one of operation conditions comprising a measured temperature of at least one storage chamber formed in the refrigerator, the number of times a door section coupled to a main body section of the refrigerator is opened and closed, a switching time of the door section, and whether or not the door section fails is satisfied;

calculating, at each predetermined check time, an operation ratio of a compressor in a cooling cycle section generating cold air supplied to the storage chamber and comprising the compressor, a condenser, and an evaporator, when the refrigerator is operated in the power-saving mode;

comparing the operation ratio with a predefined threshold operation ratio; and operating a defrost section for removing frost from the evaporator when the operation ratio is equal to or greater than the threshold operation ratio.

2. The method according to claim 1, wherein the check time interval is shorter than a predefined defrost period in the power-saving mode.

3. The method according to claim 1, wherein, in the calculating an operation ratio, the operation ratio is calculated based on a ratio of an operation time during which the compressor is operated to a sum of the operation time and a pause time during which the compressor is not operated.

4. The method according to claim 1, further comprising exiting the power-saving mode when the operation ratio is equal to or greater than the threshold operation ratio.

5. The method according to claim 1, wherein, in the operating a defrost section, the compressor is operated for each predefined defrost period in the power-saving mode when the operation ratio is less than the threshold operation ratio and the compressor is operated before reaching the defrost period when the operation ratio is equal to or greater than the threshold operation ratio.

* * * * *